US005275120A

United States Patent [19]

Ruffa et al.

[11] Patent Number: 5,275,120

[45] Date of Patent: Jan. 4, 1994

[54] STRUM-SUPPRESSANT CABLE FOR TOWED ARRAYS

[75] Inventors: Anthony A. Ruffa, Niantic; Norman Toplosky, Voluntown, both of Conn.

[73] Assignee: The United States of America as represented by the Secretary of the Navy, Washington, D.C.

[21] Appl. No.: 948,562

[22] Filed: Sep. 23, 1992

[51] Int. Cl.[5] ..... F15D 1/10

[52] U.S. Cl. ..... 114/243

[58] Field of Search ..... 114/242, 243, 253; 138/178; 174/42, 101.5

[56] References Cited

U.S. PATENT DOCUMENTS

| | | | |
|---|---|---|---|
| 2,949,090 | 8/1960 | Gerber | 114/243 X |
| 3,347,526 | 10/1967 | Cymmer et al. | 114/243 X |
| 3,884,173 | 5/1975 | Fabula | 114/243 |
| 4,190,012 | 2/1980 | Rispin et al. | 114/243 |
| 4,549,035 | 10/1985 | Zaltsberg | 114/243 X |

FOREIGN PATENT DOCUMENTS

| | | | |
|---|---|---|---|
| 0030684 | 2/1982 | Japan | 114/243 |

*Primary Examiner*—Sherman Basinger

*Attorney, Agent, or Firm*—Michael J. McGowan; Prithvi C. Lall; Michael F. Oglo

[57] ABSTRACT

A fairing for use with a tow cable and operable to suppress strumming vibrations induced in the cable as it is towed generally longitudinally of its length through water includes a plurality of tab members extending in continuous, end to end fashion over the longitudinal length of the cables' outer jacket. Each of the tab members extends radially outwardly from the outer jacket in angularly spaced relation to adjacent tab members so that the plurality of tab members extend in an indexed helical pattern along the longitudinal length of the outer jacket.

6 Claims, 2 Drawing Sheets

STRUM-SUPPRESSANT CABLE FOR TOWED ARRAYS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates generally to an underwater tow cable and, more particularly, to an underwater tow cable having a fairing thereon designed to suppress strumming vibrations capable of being induced in the cable when it is towed at shallow angle with respect to the direction of tow.

2. Description of the Prior Art

In a towed array system transverse vibrations of large amplitude occur due to vortex shedding of the tow cable. These vibrations lead to serious mechanical problems. In general, a typical acoustic oceanographic instrumentation system might include a weighted cable towed from a vessel, and an acoustical array containing one or more hydrophones connected to the tow cable. The tow cable is affected by relative water motions which act on it as it is pulled through the water by the vessel. These relative water motions acting on the tow cable set up a mechanical wave motion in the cable known in the art as "strum". Strum is transverse vibrations similar in nature to the well understood resonant tensioned strings as used on musical instruments.

Strum, or vortex-induced cable vibration, can be induced in a cable which tows at an angle with respect to water flow. Strum occurs as water passes about the tow cable and forms a succession of fluid eddies or vortexes on the lee side of the cable. Each vortex gives rise to a pressure differential on the side of the cable causing a transverse mechanical displacement of the cable. This, in turn, enhances the formation of the next vortex. The organized or coherent action of vortex shedding along a sufficient length of cable is believed to be a primary requirement for the occurrence of cable strum.

In the past, various methods have been employed to suppress the occurrence of strum in tow cables. These various methods have all centered around altering the exterior of the tow cable. However, the alterations tried to date have not been very satisfactory in suppressing strum for many applications of the towed systems. Specifically, the alterations are often not effective at the low incidence angles characteristic of many critical angle towed array systems, or they are not compatible with the handling units of the towed systems.

Consequently, there is a need for an improved design tow cable operable to suppress the occurrence of strum in a towed array system at low incidence angles. In addition, there is a need for an improved design tow cable capable of being easily manipulated with existing handling systems.

SUMMARY OF THE INVENTION

The present invention is directed to an improved tow cable designed to satisfy the aforementioned needs. The tow oable of the present invention, which includes a cable having an inner core surrounded by an outer jacket, further includes a cable fairing secured to the outer jacket formed from a plurality of individual tabs positioned end to end and aligned with the longitudinal axis of the cable. The tabs extend over the entire length of the cable. The plurality of tabs are flexible members angularly spaced from each other to form an index helical pattern because the tabs fold over easily as the cable goes through the handling system. Since the tabs are formed from a flexible material, problems normally associated with tow cable handling are eliminated. The flexible tabs positioned on the outer jacket in an indexed helical fashion act as flow spoilers to prevent coherent vortex shedding resulting in the suppression of tow cable strum.

Accordingly, the present invention provides a cable fairing in combination with a tow cable of preselected length and having an inner core surrounded by an outer jacket. The fairing, which is operable to suppress strumming vibrations induced in the cable as it is towed generally longitudinally of its length through water, includes a plurality of tab members extending in continuous, end to end fashion over the longitudinal length of the outer jacket. Each tab member extends radially outwardly from the cable outer jacket in angularly spaced relation to adjacent tab members so that the plurality of tab members extend as an indexed helix along the longitudinal length of the outer jacket.

These and other advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DESCRIPTION OF THE PREFERRED EMBODIMENT

Figure 1:
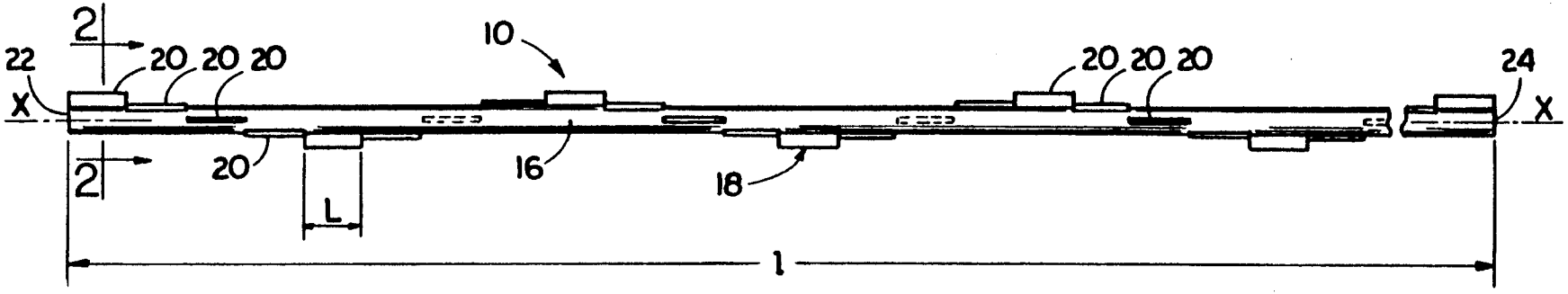
FIG. 1 is a view in side elevation of a first embodiment of the strum-suppressant tow cable of the present invention, illustrating a plurality of individual tab members positioned in helical fashion along the axial length of the cable.

In the following description, like reference characters designate like or corresponding parts throughout the several views. Also in the following description, such terms as "forward", "rearward", "left", "right", "front", "back" and the like, are words of convenience and are not to be construed as limiting terms.

Figure 2:
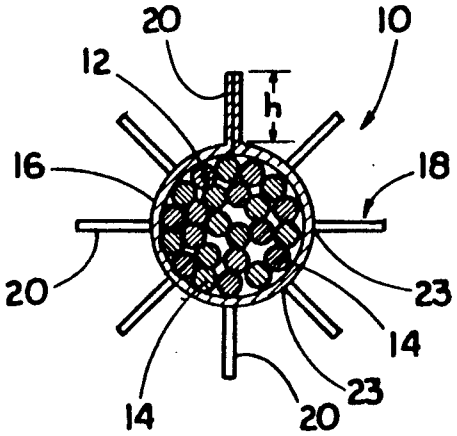
FIG. 2 is a cross-sectional view of the tow cable taken along line 2—2 of FIG. 1, illustrating the tab members extending radially outwardly from the cables' outer jacket.

Now referring to the drawings, and particularly to FIGS. 1 and 2, there are illustrated side elevational and cross-sectional views, respectively, of one embodiment of the strum-suppressant tow cable of the present invention and generally designated by the numeral 10. The cable 10, which has an overall longitudinal length 1, includes an inner core 12 formed from a plurality of individual cables 14. The cables 14 may be electrical or electronic signal conductors for providing an electrical connection between hydrophones pulled by the tow cable 10 and electrical or electronic information manipulating and analyzing equipment on board the vessel pulling the hydroponic array. In addition, one or more of the individual cables 14 may be mechanical cables for providing the cable 1 with sufficient strength to prevent the cable 10 from being damaged during operation. The tow cable 10 further includes an outer jacket 16 which surrounds the inner core 12. Typically, the outer jacket 16 is made from a substantially smooth, flexible and waterproof material to prevent sea water from entering the inner core 12 and causing damage to the individual cables 14 forming the inner core 12.

A fairing generally designated by the numeral 18 and positioned on the cables' outer jacket 16 is operable to suppress strum which would otherwise be generated as the cable 10 is towed through water. The fairing 18 suppresses strum since it modifies the outer jacket 16 of the cable 10 sufficiently to disturb the flow pattern of water around the cable 10. As seen particularly in FIG. 1, the fairing 18 is formed from a plurality of individual tab members 20 which extend in an end-to-end fashion along the longitudinal length 1 of the cable 10. Each of the tab members 20 is formed from a suitable flexible material such as polyethylene or some other compatible polymer film. If desired, the tab members 20 may be formed from the same material as the cable outer jacket 16. As seen particularly in FIG. 2, each of tab members 20 extends radially outwardly from the cables' outer jacket 16. The end portion 23 of each tab member 20 is fixedly mounted by bonding to the outer jacket 16 by suitable means, such as gluing, heat sealing, or ultrasonic welding and is positioned normal to the outer jacket 16 with the end portion 23 being parallel to the longitudinal axis X—X of cable 10. The method of bonding is dependent upon the composition of the materials used to form the outer jacket 16 and the tab members 20. The preferred bonding method is by heat sealing a compatible film to the jacket. For example, for a polyethylene jacket, a polyethylene film would be sealed using nichrome wires to provide the necessary reinforce heat.

Each of the tab members 20 is positioned on the outer jacket 16 to lie in substantially parallel relationship with the longitudinal axis x—x of the cable 10. Each of the tab members 20 is angularly spaced from adjacent tab members 20 by the same preselected angle, preferably 45 degrees, either in the clockwise direction all the way through or counter-clockwise direction, to provide that the plurality of tab members 20 forms an indexed helical pattern on the cables' outer jacket 16. This helical pattern extends over the entire length 1 of the cable 10. For example, the tab member 20 located at the first end portion 22 of the cable 10 is secured to the outer jacket 16 so as to extend vertically in an upward direction. If the tab member 20 located at the first end portion 22 of the cable 10 is referred to as a reference tab member 20, then the tab member 20 adjacent to or to the right of the reference tab member 20 is angularly spaced from the reference tab member 20 by a clockwise angle of forty five (45) degrees when viewed from the first end portion 22 of the cable 10 towards the cables' second end portion 24. Since each tab member 20 located between the first and second end portions 22, 24 of the cable 10 is angularly spaced by an incremental clockwise angle of forty five (45) degrees from the tab member 20 immediately to its left, the continuous helical pattern formed by the tab members 20 is a right hand helical pattern when viewed from the first end portion 22 of the cable 10 towards the second end portion 24 of the cable 10. Through experimentation, it has been found that for optimum performance for an outside diameter of one inch, each tab member 20 should have longitudinal length L of three (3) inches. Therefore, eight (8) tab members 20 are required to circumscribe three hundred and sixty (360) degrees or one revolution of the outer jacket 16 over two (2) feet of the cable 10 longitudinal length. In addition, each tab member 20 should extend radially outwardly from the outer jacket 16 by a distance h between approximately one quarter (0.25) inch and two (2) inches. For cables of different size and different tow speed ranges the dimensions given would have to be scaled.

It should be understood that the incremental spacing angle may be reversed to an incremental counterclockwise angle of forty five (45) degrees if desired to form a left hand indexed helical pattern of tab members 20 on the cables' outer jacket 16 without reducing the efficiency of the fairing 18. In addition, the plurality of tab members 20 forming the fairing 18 may be arranged on the outer jacket 16 of the cable so as to form a right hand helical pattern extending from the first end portion 22 of the cable 10 to the midpoint of the cable 10 between the first and second end portions 22, 24 and a left hand helical pattern between the midpoint of the cable 10 and the cable second end portion 24.

Figure 3:
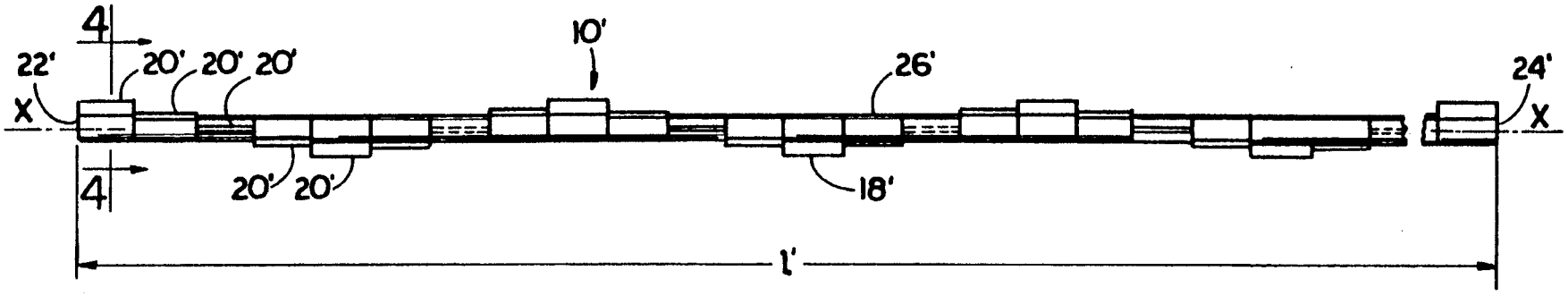
FIG. 3 is a view in side elevation of a second embodiment of the strum-suppressant cable of the present invention, illustrating a plurality of individual tab members each formed from a flexible tape material o suitable polymer film and positioned in an indexed helical fashion along the longitudinal length of the cable.
Figure 4:
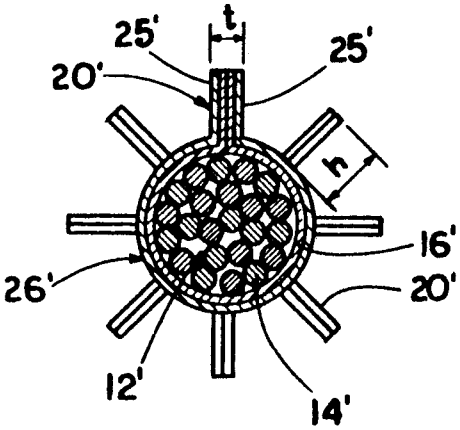
FIG. 4 is a cross-sectional view of the tow cable taken along line 4—4 of FIG. 3, illustrating the end portions of the tape material defining the tab members extending radially outwardly from the outer jacket of the cable.

Now referring to FIGS. 3 and 4, there are illustrated side elevational and cross sectional views of an another embodiment of the strum-suppressant tow cable of the present invention, generally designated by the numeral 10'. As seen in FIGS. 3 and 4, the tow cable 10' includes an inner core 12' formed from a plurality of individual cables 14' and an outer jacket 16'. The inner core 12', individual cables 14' and outer jacket 16' of the cable 10' are identical to the inner core 12, individual cables 14 and outer jacket 16 described with respect to the cable 10 of FIGS. 1 and 2. In addition, a fairing 18' formed from a helical pattern of tab members 20' extends between the first and second end portions 22', 24' of the cable 10' in exactly the same manner as the helical pattern of tab members 20 extends between the first and second end portions 22, 24 of the cable 10. The only difference between the embodiment illustrated in FIGS. 3 and 4 and the embodiment illustrated in FIGS. 1 and 2 is that the tab members 20' forming the fairing 18' of the FIGS. 3 and 4 embodiment are made from a tape material. As seen particularly in FIG. 4, each tab member 20' is defined by the radially extending and overlapping end portions 25 of a section of tape 26' which is wrapped around the outer jacket 16' of the cable 10'. The section of tape 26' may either be a single or double layer. Each of the plurality of tab members 20' extending along the longitudinal length 1' of the cable 10' is formed in this fashion. Test results using single and double layers of tape 26' to form the tab member 20' are set forth in the following example.

EXAMPLE

Both single and double layers of vinyl tape were used to form each tab member 20'. The original vinyl tape used was eight (8) MILS (8 one thousandths of an inch) thick, which led to a tab member thickness t of sixteen (16) MILS. The double layer tab member was made from two (2) layers of five (5) MIL thick vinyl tape, which led to a tab member thickness t of twenty (20) MILS. It was found that the increase in tab member thickness t from sixteen (16) to twenty (20) MILS effectively doubled the rigidity (resistance to bending) of the tape. It was further found that the increase in thickness led to improved strum suppression and also led to better reproducibility from test run to test run. Trimming the tab member height h from one and one-quarter ($1\frac{1}{4}$) inches to three-quarter ($\frac{3}{4}$) inch and even to three-eights ($\frac{3}{8}$) inch did not significantly affect the performance of the doublelayered tab member design. By comparison, the single layer tab member showed progressively less strum suppression as the tab member height was reduced from one (1) inch to one-half ($\frac{1}{2}$) inch. The two (2) inch single layer tab member had comparable performance to the shorter double layer tab member.

Both the two (2) inch single layer tab member and the one and one-quarter ($\frac{1}{4}$) inch double layer tab member had broadband acceleration levels which were less than ten (10) dB higher than the background (acceleration level for zero (0) degree incidence angle at the same speed) at strum frequencies. By comparison, the plain jacketed tow cable without strum suppressant fairing showed tonals (narrow band energy) which were thirty (30) to forty (40) dB above the background at strum frequencies.

In addition to the use of vinyl tape, ten (10) MILS polyethylene film was used to form the tab members. The film was ultrasonically welded to the polyethylene outer jacket of a tow cable in the same indexed helical pattern as described herein. In this design, the tab members were tangent to the cable, as opposed to the tape tab members, which are normal to the cable and extend radially outward. The performance of this design was comparable to a tape tab member of one (1) inch height.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the forms hereinbefore described being merely preferred or exemplary embodiments thereof.

What is claimed is:

1. In combination with a tow cable of preselected length and having an inner curve surrounded by an outer jacket, a fairing on the outer jacket of the two cable for suppressing strumming vibrations induced in the cable as it is towed generally longitudinally of its length through water, comprising:

a plurality of flexible tab members arranged in an end-to-end fashion over the longitudinal length of said outer jacket, each tab member being of a planar configuration and having one side edge fixedly mounted normal to said outer jacket with said mounted side edge being parallel to the longitudinal axis of said cable, said tab members extending radially outwardly from said outer jacket and angularly spaced relative to one another so as to form an indexed helix along the longitudinal length of said outer jacket.

2. The fairing as recited in claim 1, wherein each of said tab members is angularly spaced from adjacent tab members by an angle of approximately forty five (45) degrees.

3. The fairing as recited in claim 2, wherein each of said tab members is approximately three (3) inches in length measured along the longitudinal axis of said cable and extends radially outwardly from said outer jacket between approximately one-quarter (0.25) inch to two (2) inches.

4. The fairing as recited in claim 3, wherein eight (8) of said tab members circumscribe three hundred and sixty (360) degrees of said outer jacket over two (2) feet of said cables' longitudinal length.

5. The fairing as recited in claim 1, wherein each of said tab members is made of a polymer film and is bonded to said outer jacket.

6. The fairing as recited in claim 1, wherein each of said tab members is formed from the overlapping end portions of at least one layer of tape wrapped around and secured to said outer jacket.

* * * * *